US005630725A

United States Patent [19]

Green et al.

[11] Patent Number: 5,630,725

[45] Date of Patent: May 20, 1997

[54] LOW PROFILE SWITCH ASSEMBLY

[75] Inventors: Eric T. Green, Harrisburg; Brent D. Yohn, Newport, both of Pa.

[73] Assignee: The Whitaker Corporation, Wilmington, Del.

[21] Appl. No.: 559,514

[22] Filed: Nov. 15, 1995

[51] Int. Cl.[6] ..... H01R 29/00

[52] U.S. Cl. ..... 439/188; 439/376

[58] Field of Search ..... 439/188, 79, 80, 439/374, 376

[56] References Cited

U.S. PATENT DOCUMENTS

| | | | |
|---|---|---|---|
| 4,687,267 | 8/1987 | Header et al. | 439/79 |
| 4,941,841 | 7/1990 | Darden et al. | 439/374 |
| 5,098,306 | 3/1992 | Noschese et al. | 439/188 |
| 5,248,259 | 9/1993 | Naito et al. | 439/188 |
| 5,286,215 | 2/1994 | Dewey et al. | 439/188 |

*Primary Examiner*—Neil Abrams
*Assistant Examiner*—T. C. Patel
*Attorney, Agent, or Firm*—Anton P. Ness

[57] ABSTRACT

A low profile switch having a receptacle assembly and a plug assembly mounted to surfaces which are movable with respect to each other. The receptacle assembly includes a housing with a defined recess into which extend a pair of contact members resiliently biased into engagement with each other. The plug assembly includes a housing having an elongated extension with a pair of contact members disposed on opposed sides thereof so that the extension can be moved into the recess of the receptacle assembly, separate the contact members of the receptacle assembly, and engage the contact member of the receptacle assembly with respective ones of the contact members of the plug assembly. Thus, when the receptacle and plug assemblies are unmated, the receptacle assembly provides a shunted circuit condition and when the receptacle and plug assemblies are mated, two circuit paths are established between the receptacle and plug assemblies.

9 Claims, 4 Drawing Sheets

LOW PROFILE SWITCH ASSEMBLY

BACKGROUND OF THE INVENTION

This invention relates to switches and, more particularly, to a low profile switch assembly having two matable parts which are movable toward and away from each other between first and second positions to selectively open and close different circuit paths depending upon whether the switch parts are mated or unmated.

At times a switch is needed to detect the movement of a first element to a predetermined position with respect to a second element. In particular, it may be desired to complete a circuit path when a matched pair of coaxial coupling rings is rotated into a predetermined position and also to provide an electrical shunt across two circuit elements when the coupling rings are not in the predetermined position. It is therefore an object of the present invention to provide a switch assembly which satisfies those requirements.

In such an arrangement, it would be desirable to place the switch assembly between the two coaxial coupling rings, so as to limit its exposure and minimize the possibility of damage thereto. It is therefore another object of the present invention to provide a switch assembly of the type described which has a sufficiently low profile to operate between two coaxial coupling rings.

SUMMARY OF THE INVENTION

The foregoing and additional objects are attained in accordance with the principles of this invention by providing a low profile switch having first and second matable assemblies each disposed on a respective one of opposed adjacent first and second surfaces of respective first and second articles which are relatively slidable along a line of travel with respect to each other between first and second relative positions. The switch comprises a receptacle assembly and a plug assembly. The receptacle assembly includes a first dielectric housing secured to the first surface, with the first housing defining a recess open toward the second position, a first pair of contact members mounted to the first housing and extending into the recess, the first pair of contact members being resiliently biased into engagement with each other and being movable toward and away from each other substantially in a plane parallel to the first surface and transverse to the line of travel, and first circuit means connected to the first pair of contact members. The plug assembly includes a second dielectric housing secured to the second surface, the second housing having an elongated extension with a longitudinal axis parallel to the line of travel, the extension being so positioned that when the first and second surfaces are moved relatively from the first position to the second position a forward end of the extension enters the first housing recess and separates the first pair of contact members. The plug assembly further includes a second pair of contact members mounted to the extension on opposed sides thereof and generally parallel to the longitudinal axis so that when the extension separates the first pair of contact members each of the second pair of contact members engages a respective one of the first pair of contact members, and second circuit means connected to the second pair of contact members.

In accordance with an aspect of this invention, the forward end of the second housing extension is tapered to aid the separation of the first pair of contact members.

In accordance with another aspect of this invention, the second surface is on an article having a third surface opposed to the second surface, the second circuit means is disposed on the third surface, and each of the second pair of contact members includes an extension which passes through the article from the second surface to the third surface for connection to the second circuit means.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
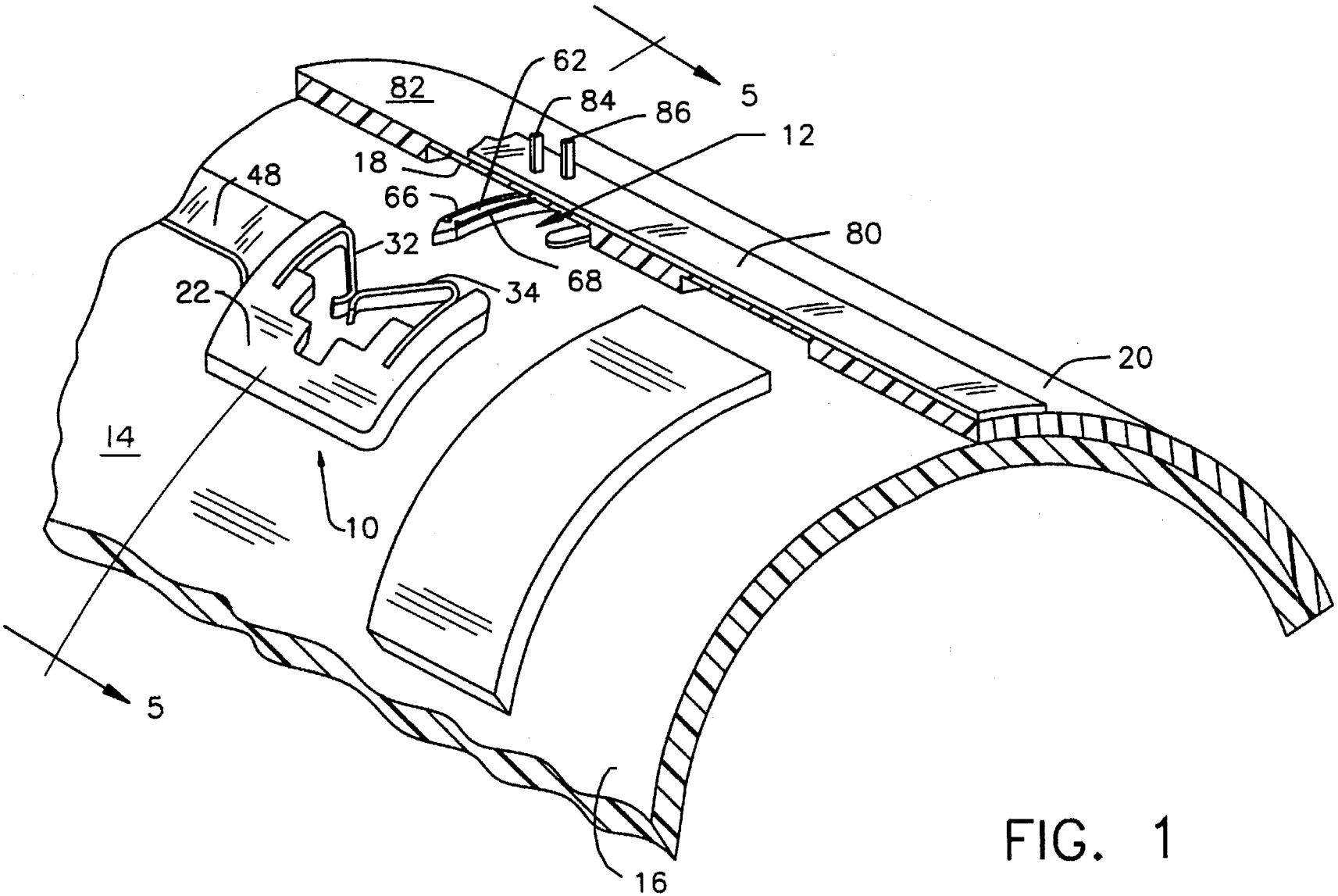
FIG. 1 is a perspective view showing the receptacle and plug assemblies of the switch according to the present invention mounted on a pair of nested cylindrical shell members which are relatively rotatable to mate the receptacle and plug assemblies.

Referring now to the drawings, FIG. 1 illustrates a low profile switch according to this invention which includes a receptacle assembly 10 and a plug assembly 12 which are matable one with the other. As shown, the receptacle assembly 10 is mounted on a surface 14 which is the outer surface of the cylindrical shell 16. Similarly, the plug assembly 12 is mounted to the surface 18, which is an inner surface of the cylindrical shell 20. The shells 16, 20 are nested coaxially, as shown, one within the other, and are constrained for movement relative to each other in an arcuate path about their common axis. (Although shown as being cylindrical, the surfaces 14, 18 could be flat and parallel and relatively slidable one over the other in a path parallel to both.) In any event, the surfaces 14, 18 face each other and are spaced a predetermined distance apart, providing room for accommodating the receptacle assembly 10 and the plug assembly 12 therebetween.

Figure 2:
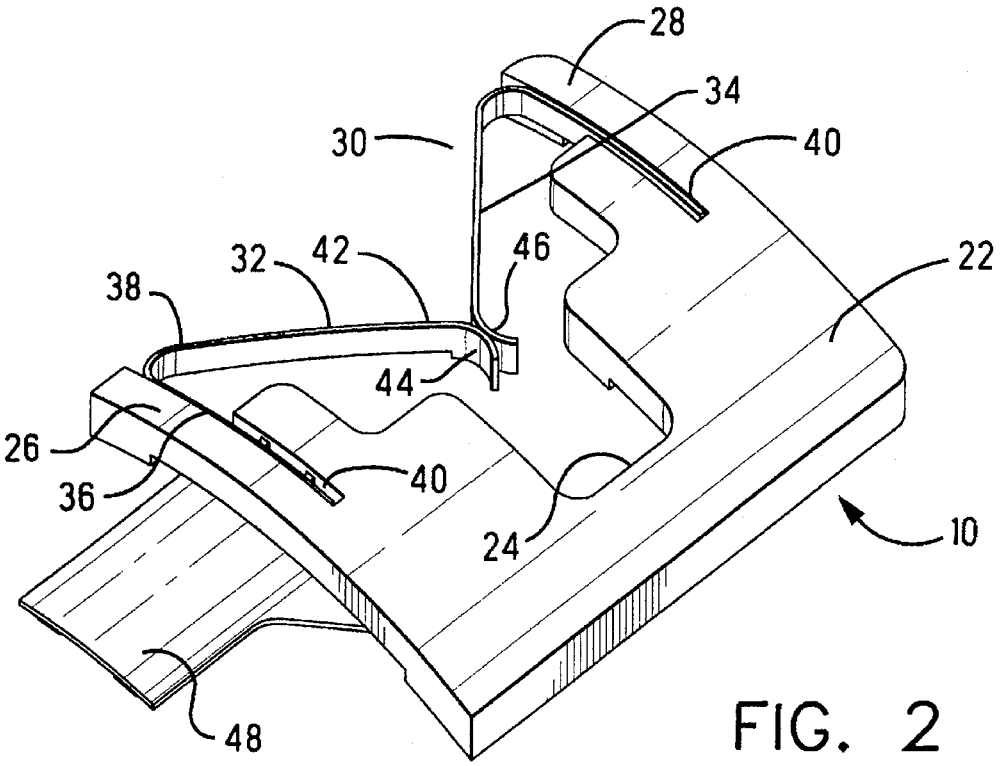
FIGS. 2 and 3 are top and bottom perspective views, respectively, of the receptacle assembly of the inventive switch.
Figure 3:
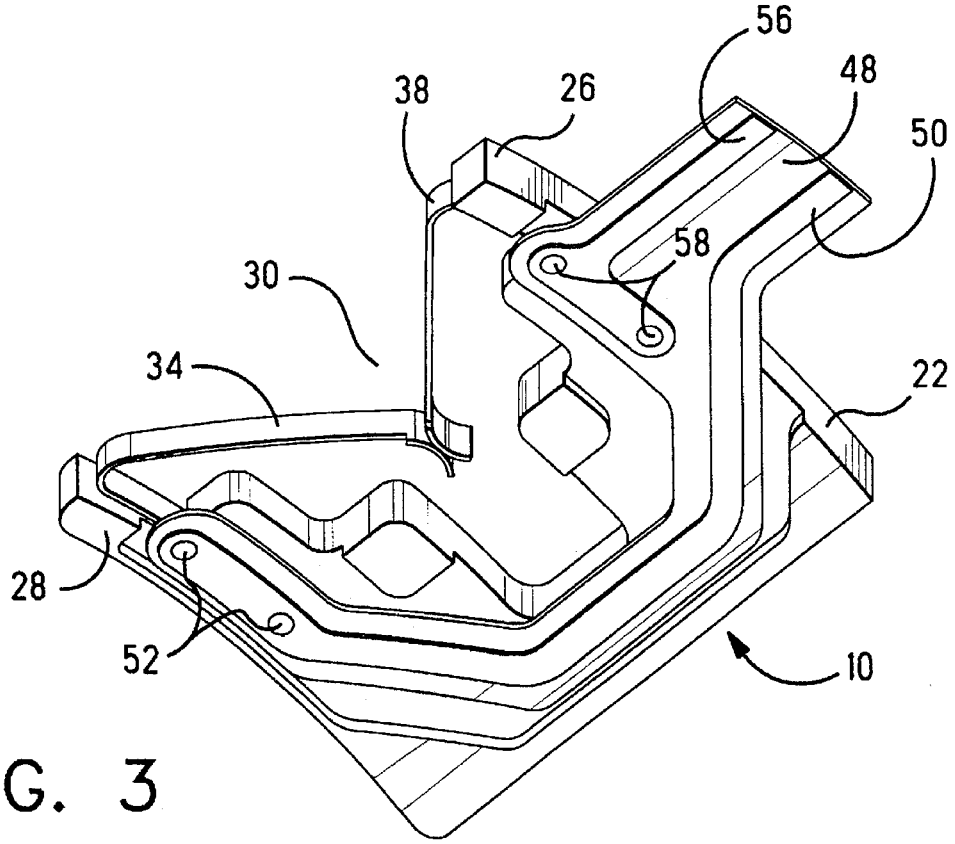
Figure 6:
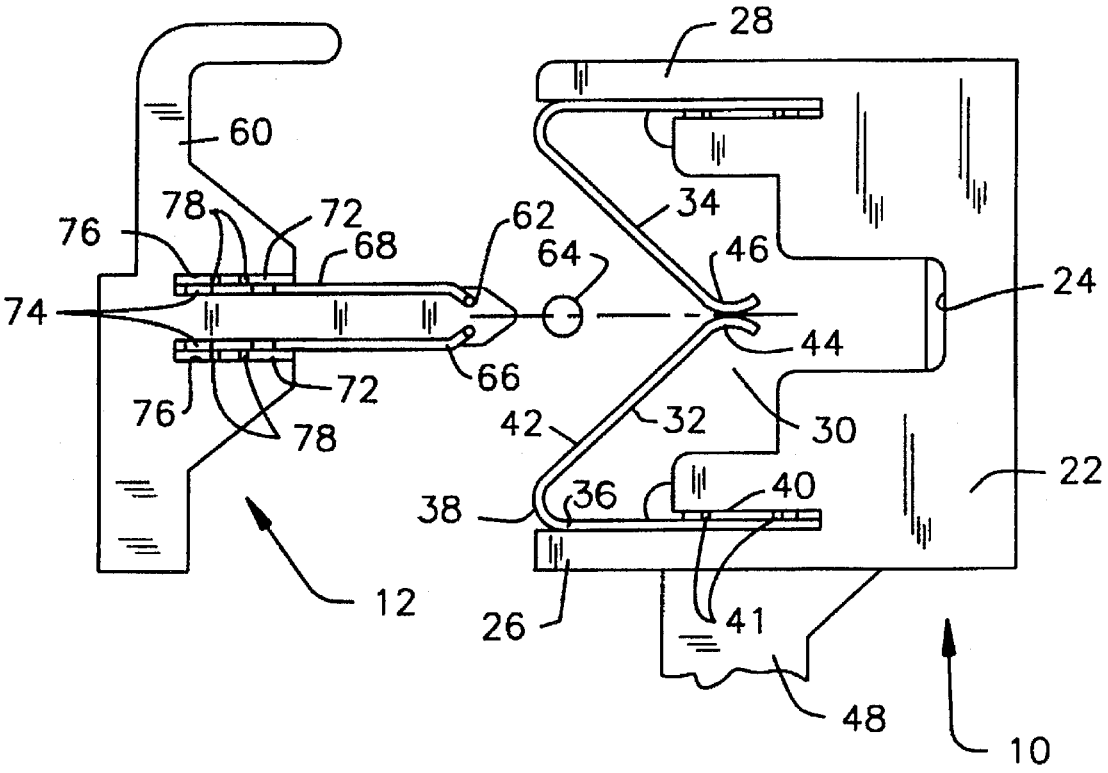
FIG. 6 is a plan view showing the plug and receptacle assemblies in their unmated condition.

Referring to FIGS. 1–3, the receptacle assembly 10 includes a dielectric housing 22 which is of generally uniform thickness orthogonal to the surface 14 on which it is secured. The thickness of the housing 22 is relatively small compared to the extent of the housing 22 in directions parallel to the surface 14, thereby providing a low profile for the receptacle assembly 10. The housing 22 includes a rear wall 24 and a pair of side arms 26, 28 which extend forwardly from the rear wall 24 generally parallel to the line of travel of the cylindrical shell 16 and generally parallel to the surface 14. The pair of side arms 26, 28 and the rear wall 24 define and bound a recess 30 in the housing 22 which is open toward the position attained by the cylindrical shell 16 when the assemblies 10, 12 are mated. The assembly 10 further includes a pair of contact members 32, 34 mounted to the housing 22 and extending into the recess 30. Each of the contact members 32, 34 is substantially V-shaped with two arms extending from a vertex. Thus, the contact member 32 includes an arm 36 extending rearwardly from the vertex 38 and secured in a slot 40 in the housing 22 so that it is parallel to and adjacent the side arm 26, with the vertex 38 being proximate the forward end of the side arm 26. To hold the contact member 32, the inner wall of the slot 40 is formed with a pair of projections 41 (FIG. 6) which bear against the contact member 32. The other arm 42 of the contact member 32 extends rearwardly from the vertex 38 into the recess 30 and toward the other contact member 34. The distal end 44 of the contact member arm 42 is slightly curved back toward the side arm 26. In addition, the distal end 44 is widened so that its lower edge rides on the surface 14 to maintain engagement of the contacts of the plug and receptacle assemblies during mating. The other contact member 34 is formed as the mirror image of the contact member 32. The dimensions of the contact members 32, 34 are such that their distal ends 44, 46 are resiliently biased into engagement with each other and are movable toward and away from each other substantially in a plane parallel to the surface 14 and transverse to the line of travel of the cylindrical shell 16.

The receptacle assembly 10 further includes a flexible film circuit element 48 which is connected to the contact members 32, 34. The flexible film circuit element 48 is disposed between the housing 22 and the surface 14. As best shown in FIG. 3, the flexible film circuit element 48 includes a first circuit trace 50 which is connected to the contact member 34 by being soldered at two points 52 to extensions 54 (FIG. 5) of the contact member 34. Similarly, the flexible film circuit element 48 has a circuit trace 56 which is connected to the contact member 32 at the solder points 58. Thus, when the assemblies 10, 12 are not mated, a shunt condition exists between the circuit traces 50, 56.

Figure 4:
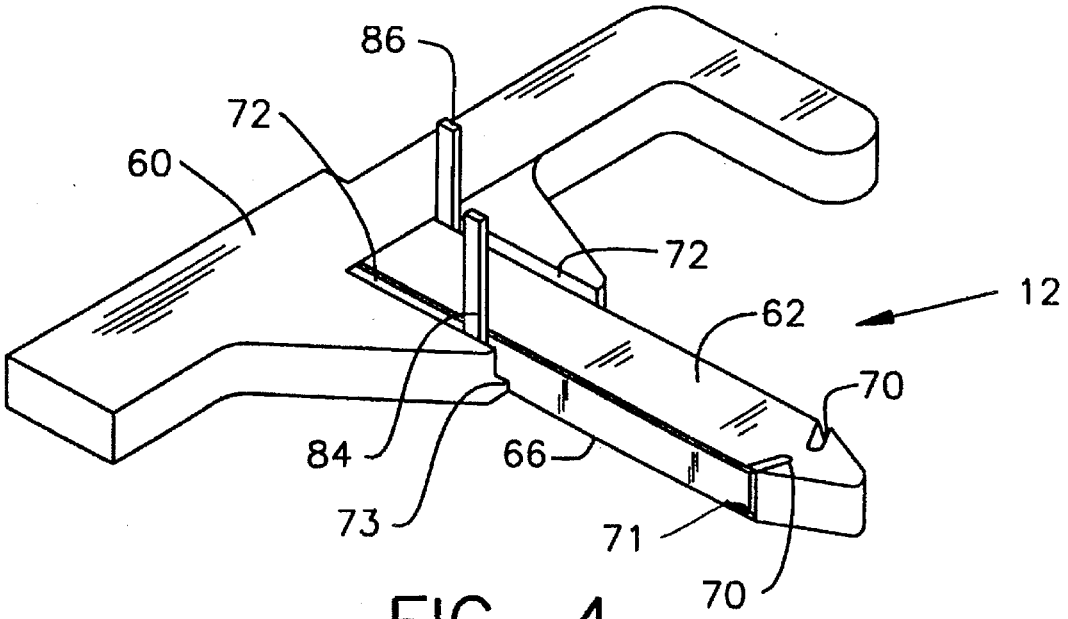
FIG. 4 is a top perspective view of the plug assembly of the inventive switch.
Figure 5:
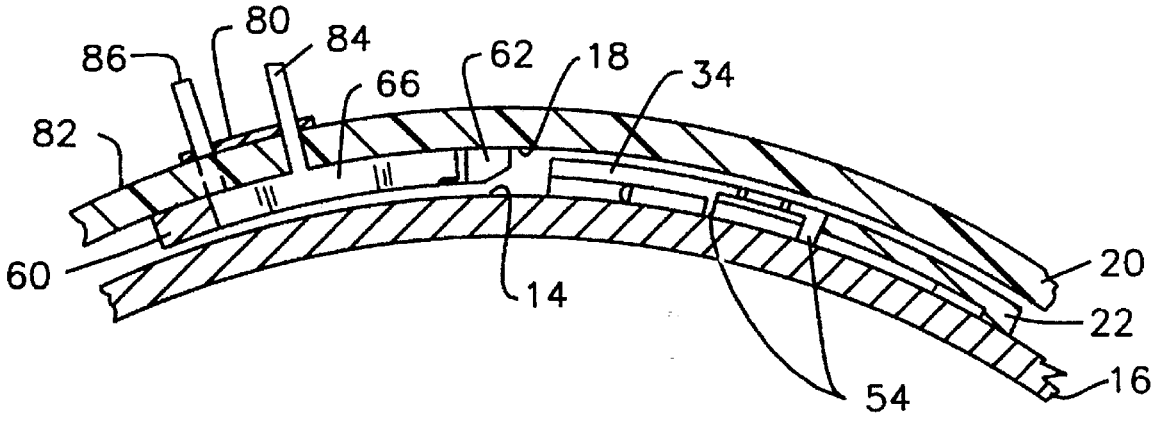
FIG. 5 is a cross sectional view taken along the line 5—5 in FIG. 1.

The plug assembly 12 of FIGS. 1 and 4 includes a dielectric housing 60 whose generally uniform thickness orthogonal to the surface 18 is substantially the same as the thickness of the housing 22. Each of these thicknesses is approximately 80% of the spacing between the surfaces 14, 18, so that the housings 22, 60 overlap approximately 60% of the spacing, as best seen in FIG. 5.

Figure 7:
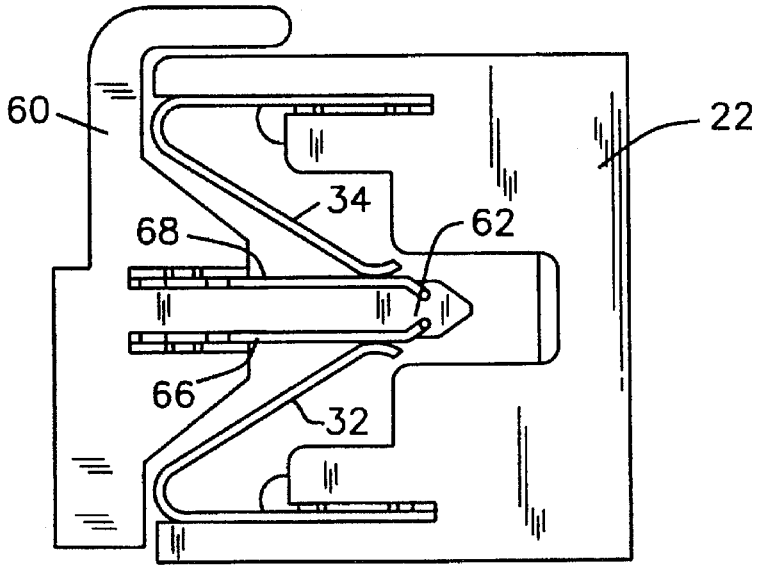
FIG. 7 is a plan view showing the mated condition of the plug and receptacle assemblies.

The housing 60 includes an elongated extension 62 having a longitudinal axis 64 (FIG. 6) which is parallel to the line of travel of the cylindrical shell 20. The extension 62 is so positioned that when the shells 16, 20 are moved from the unmated positions of the assemblies 10, 12 to the mated positions, the forward end of the extension 62 enters the recess 30 of the housing 22 and separates the contact members 32, 34, as best seen in FIG. 7. To assist in such separation, the forward end of the extension 62 is tapered.

The plug assembly 12 further includes a pair of contact members 66, 68 mounted to the extension 62 on opposed sides thereof and generally parallel to the longitudinal axis 64. As shown, the extension 62 is formed with a pair of slots 70 proximate the forward end of the extension 62 and extending part way into the extension 62 from the opposed sides. Immediately rearward of each slot 70, the extension 62 is formed with a ledge 71 to support a narrowed region of the contact member 66. The housing 60 is further formed with another pair of slots 72 which are parallel to the longitudinal axis 64 and are rearward of the extension 62. Immediately forward of each slot 72, the extension 62 is formed with a ledge 73 to support a narrowed region of the contact member 66. Accordingly, the width of the contact member 66 between the ledges 71 and 73 is maximized to improve the overlap of the plug and receptacle assembly contact members during mating. Each of the slots 72 has an inner wall 74 which is an extension of a respective one of the opposed sides of the extension 62. Thus, each of the contact members 66, 68 is mounted with a first end in one of the slots 70 and a second end in the one of the slots 72 which is on the same one of the opposed sides of the extension 62 as the respective slot 70. To hold the contact members 66, 68, the outer walls 76 of the slots 72 are each formed with a pair of projections 78 which bear against the respective one of the contact members 66, 68. Thus, the contact members 66, 68 are maintained flush against the opposed sides of the extension 62 so that when the extension 62 separates the contact members 32, 34, the contact member 66 engages the contact member 32 and the contact member 68 engages the contact member 34.

The plug assembly 12 further includes a flexible film circuit element 80 (FIGS. 1 and 5) which is disposed on the outer surface 82 of the cylindrical shell 20. To provide contact between the plug assembly 12 and the flexible film circuit element 80, each of the contact members 66, 68 is formed with a respective extension 84, 86 which passes through a suitable opening in the shell 20. The flexible film circuit element 80 includes two circuit traces (not shown), each of which is soldered to a respective one of the extensions 84, 86.

Thus, when the shells 16, 20 are in a first relative position where the assemblies 10, 12 are unmated, the receptacle assembly 10 provides a shunted circuit condition. When the shells 16, 20 are in a second relative position where the assemblies 10, 12 are mated, a circuit path is formed between the contact members 32 and 66 and another circuit path is formed between the contact members 34 and 68.

As discussed above, each of the housing 22, 60 thicknesses is approximately 80% of the spacing between the surfaces 14, 18, so that the housings 22, 60 overlap approximately 60% of the spacing. Although the height of the contact members 32, 34, 66, 68 is less than the height (thickness) of the housings 22, 60, to prevent damage to the contact members during rotation and sliding of the shells 16, 20, the 60% overlap of the housings 22, 60 is sufficient to provide a suitable wiping area for the contact members.

Accordingly, there has been disclosed an improved low profile switch assembly. It is understood that the above-described embodiment is merely illustrative of the application of the principles of this invention. Numerous other embodiments may be devised by those skilled in the art without departing from the spirit and scope of this invention, as defined by the appended claims.

What is claimed is:

1. A low profile switch having first and second matable assemblies each disposed on a respective one of opposed adjacent first and second surfaces of respective first and second articles which are relatively slidable along a line of travel with respect to each other between first and second relative positions, the switch comprising:

a receptacle assembly including:

a first dielectric housing secured to said first surface, said first housing defining a recess open toward said second position;

a first pair of contact members mounted to said first housing and extending into said recess, said first pair of contact members being resiliently biased into engagement with each other and being movable toward and away from each other substantially in a plane parallel to said first surface and transverse to said line of travel; and first circuit means connected to said first pair of contact members; and a plug assembly including:

a second dielectric housing secured to said second surface, said second housing including an elongated extension having a longitudinal axis parallel to said line of travel, said extension being so positioned that when said first and second surfaces are moved relatively from said first position to said second position a forward end of said extension enters said first housing recess and separates said first pair of contact members;

a second pair of contact members mounted to said extension on opposed sides thereof and generally parallel to said longitudinal axis so that when said extension separates said first pair of contact members each of said second pair of contact members engages a respective one of said first pair of contact members; and second circuit means connected to said second pair of contact members.

2. The switch according to claim 1 wherein the forward end of said second housing extension is tapered to aid the separation of said first pair of contact members.

3. The switch according to claim 1 wherein said first circuit means includes a flexible film circuit element between said first housing and said first surface.

4. The switch according to claim 1 wherein said second housing extension is formed with a first pair of slots proximate said forward end and extending part way into said extension from said opposed sides and said second housing is formed with a second pair of slots parallel to said longitudinal axis and rearward of said extension, each of said second pair of slots having an inner wall which is an extension of a respective one of said opposed sides, and each of said second pair of contact members is mounted with a first end in one of said first pair of slots and a second end in that one of said second pair of slots which is on the same one of said opposed sides as said one of said first pair of slots.

5. The switch according to claim 1 wherein said first and second surfaces are on respective ones of a pair of concentric cylindrical shells, said first and second surfaces face each other and are spaced a predetermined distance apart, and each of said first and second housings has a generally uniform thickness orthogonal to said first and second surfaces which is approximately 80% of said predetermined distance.

6. The switch according to claim 1 wherein:

said second surface is on said second article which has a third surface opposed to said second surface;

said second circuit means is disposed on said third surface; and each of said second pair of contact members includes an extension which passes through said article from said second surface to said third surface for connection to said second circuit means.

7. The switch according to claim 6 wherein said second circuit means includes a flexible film circuit element.

8. The switch according to claim 1 wherein said first housing includes a rear wall and a pair of side arms, said pair of side arms extending forwardly from the rear wall generally parallel to said line of travel and said first surface, said recess being defined and bounded by said pair of side arms and said rear wall.

9. The switch according to claim 8 wherein each of said first pair of contact members is substantially V-shaped with two arms extending from a vertex, a first of each contact member arms being mounted to said first housing closely adjacent a respective first housing side arm, each contact member vertex being proximate the forward end of the respective first housing side arm, and each other contact member arm extending rearwardly into said recess and toward the other of said first pair of contact members.

* * * * *